US012723832B2

(12) United States Patent
Patel

(10) Patent No.: US 12,723,832 B2
(45) Date of Patent: Sep. 1, 2026

(54) REVERSE THRUSTER MUZZLE BRAKE FOR FIREARMS

(71) Applicant: DEFENSE RESEARCH AND DEVELOPMENT, LLC, Dallas, GA (US)

(72) Inventor: Swetal K. Patel, Dallas, GA (US)

(73) Assignee: DEFENSE RESEARCH AND DEVELOPMENT, LLC, Dallas, GA (US)

( * ) Notice: Subject to any disclaimer, the term of this patent is extended or adjusted under 35 U.S.C. 154(b) by 0 days.

(21) Appl. No.: 19/059,828

(22) Filed: Feb. 21, 2025

(65) Prior Publication Data

US 2026/0251414 A1 Aug. 27, 2026

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/38; F41A 25/00
See application file for complete search history.

(56) References Cited

U.S. PATENT DOCUMENTS 5,036,747 A * 8/1991 McClain, III ..... F41A 21/36 89/14.3
6,216,578 B1 * 4/2001 Ledys ..... F41A 21/36 89/14.3
8,087,338 B1 * 1/2012 Hines ..... F41A 21/36 89/14.3
10,088,262 B2 * 10/2018 McMillan ..... F41A 21/28
10,473,415 B2 * 11/2019 McMillan ..... F41A 21/36
10,605,572 B1 * 3/2020 Bartoszewicz ..... F41G 11/003
10,731,940 B2 * 8/2020 McMillan ..... F41A 21/28
2010/0269387 A1 * 10/2010 Drajan ..... F41A 21/36 42/1.06

(Continued)

FOREIGN PATENT DOCUMENTS

CA 3070202 C * 2/2021 ..... F41A 21/36
EP 3665430 A2 * 6/2020 ..... F41A 21/32
WO WO-2019032261 A2 * 2/2019 ..... F41A 21/36

*Primary Examiner* — Benjamin P Lee
(74) *Attorney, Agent, or Firm* — Perilla Knox & Hildebrandt LLP; Kenneth A. Knox

(57) ABSTRACT

The present disclosure presents a muzzle break for a firearm having two portions, each comprising corresponding curved baffles, a semicircular channel running the length of the brake, circular inserts, and clamping screw receptacles. Inserts for the bore hole where the gas pressure is highest are inserted into the portions before assembly, and each half of the brake comprises a machined clearance, such that when the brake halves are assembled there is a split machined clearance over the firearm barrel outside diameter. The two halves are fastened together, with alignment pin inserts inserted into machined slots before assembly, and the inner portion of the interior channel is threaded to mate with the threading on a firearm barrel. The muzzle brake is mounted to the firearm barrel by threading the inner portion of the interior channel of the brake onto the barrel to the point of the split machined clearance. Two clamping screws are used to clamp down the barrel end of the brake inner diameter onto the barrel outer diameter to secure the brake to the barrel.

18 Claims, 3 Drawing Sheets

(56) References Cited

U.S. PATENT DOCUMENTS

| | | | | |
|---|---|---|---|---|
| 2018/0087861 | A1* | 3/2018 | McMillan | F41A 21/28 |
| 2018/0087862 | A1* | 3/2018 | McMillan | F41A 21/28 |
| 2019/0011211 | A1* | 1/2019 | McMillan | F41A 21/36 |
| 2019/0154388 | A1* | 5/2019 | Jager | F41G 1/02 |
| 2020/0049443 | A1* | 2/2020 | McMillan | F41A 21/28 |
| 2025/0164208 | A1* | 5/2025 | Cogan | F41C 23/16 |

* cited by examiner

REVERSE THRUSTER MUZZLE BRAKE FOR FIREARMS

BACKGROUND

A firearm is a type of weapon that fires rounds. Typically, a firearm, such as a rifle includes a trigger, a hammer, and a barrel. The round is positioned in the barrel, and, when the trigger is pulled, the hammer fires the round through the barrel.

A muzzle brake is a device attached to the end of a firearm barrel that utilizes a series of baffles to redirect escaping propellant gases to counteract recoil. A muzzle brake minimizes muzzle rise by channeling the expanding gases sideways, upwards, or at an angle away from the shooter instead of directly backward, typically without reducing muzzle velocity, essentially reducing the felt recoil when a shot is fired. By reducing both recoil and muzzle rise, muzzle brake devices contribute to improved accuracy, as with reduced muzzle movement a shooter can maintain steady aim. Another advantage is the increased comfort provided to shooters, as the reduction in felt recoil not only improves control but also minimizes the physical strain on the shooter's body. The reduction in recoil helps to maintain target acquisition, minimizes shooter fatigue, and enables faster target re-engagement.

When a firearm is discharged, high-pressure gases are rapidly expelled from the barrel, causing the firearm to recoil and the muzzle to rise. A muzzle brake redirects these gases to counteract the recoil and reduce muzzle rise. A muzzle brake consists of a series of ports threaded onto the muzzle. As the bullet exits the barrel, the gases are directed through these ports or baffles, creating a controlled release of energy. The expanding gases are channeled by strategically placed ports, or baffles, which are specifically designed to control the flow of gas and redirect it to counteract the forces generated during the firing process. By redirecting the gases in a direction opposite to the recoil force and in a manner that counters the rearward force generated by the bullet leaving the barrel, brakes effectively counteract the backward thrust and effectively reduce the felt recoil.

The reduction of felt recoil makes the firearm more comfortable to shoot and allows for quicker follow-up shots. Additionally, brakes also help to minimize muzzle rise by redirecting the gases upward or outward, keeping the barrel more stable during fire.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Most conventional muzzle brakes are one-piece and made from round bar stock on computer numerical control ("CNC") machines. This method of manufacturing allows for the baffles of the muzzle brake to be machined only with linear walls, either perpendicular to the barrel or angled back toward the barrel to reduce recoil. It is not possible for one-piece, CNC-machined muzzle brakes to contain baffles with a curved surface inside of the brake.

When a round is fired in a firearm with a conventional muzzle brake containing straight-wall, perpendicular or angled baffles, high pressure gases encounter the baffles. The baffles reduce the recoil by changing the direction of the high-pressure gases one time in each baffle.

The present disclosure comprises a two-piece muzzle brake with curved-surface baffles to reduce recoil felt by the shooter that can be machined in a CNC machine. The baffles redirect the gases away from the barrel and away from the shooter, thereby providing for the countering and managing of recoil forces.

Having curved baffle surfaces provides for changing the angle of deflection of encountered gas pressure at every degree along the curve, thereby continually reducing the amount of recoil felt by the shooter. The amount of recoil reduction resulting from the curved baffles can be significant, especially on large caliber firearms such as 50 bmg caliber rifles.

To address the issue of machining the curved baffles, in embodiments of the present disclosure, the muzzle brake is manufactured in two halves from aluminum, with hardened steel inserts for the bore hole where the gas pressure is highest. It is understood, however, that other materials can be employed. Each half of the brake comprises a machined clearance, such that when the brake halves are assembled there is a split machined clearance over the firearm barrel outside diameter. The two halves are fastened together by screws, such as hex-head set screws, with alignment pin inserts inserted into machined slots before assembly, and the inner portion of the interior channel is threaded to mate with the threading on a firearm barrel.

The muzzle brake is mounted to the firearm barrel by threading the inner portion of the interior channel of the brake onto the barrel to the point of the split machined clearance. Two clamping screws are used to clamp down the barrel end of the brake inner diameter onto the barrel outer diameter to secure the brake to the barrel.

Figure 1:
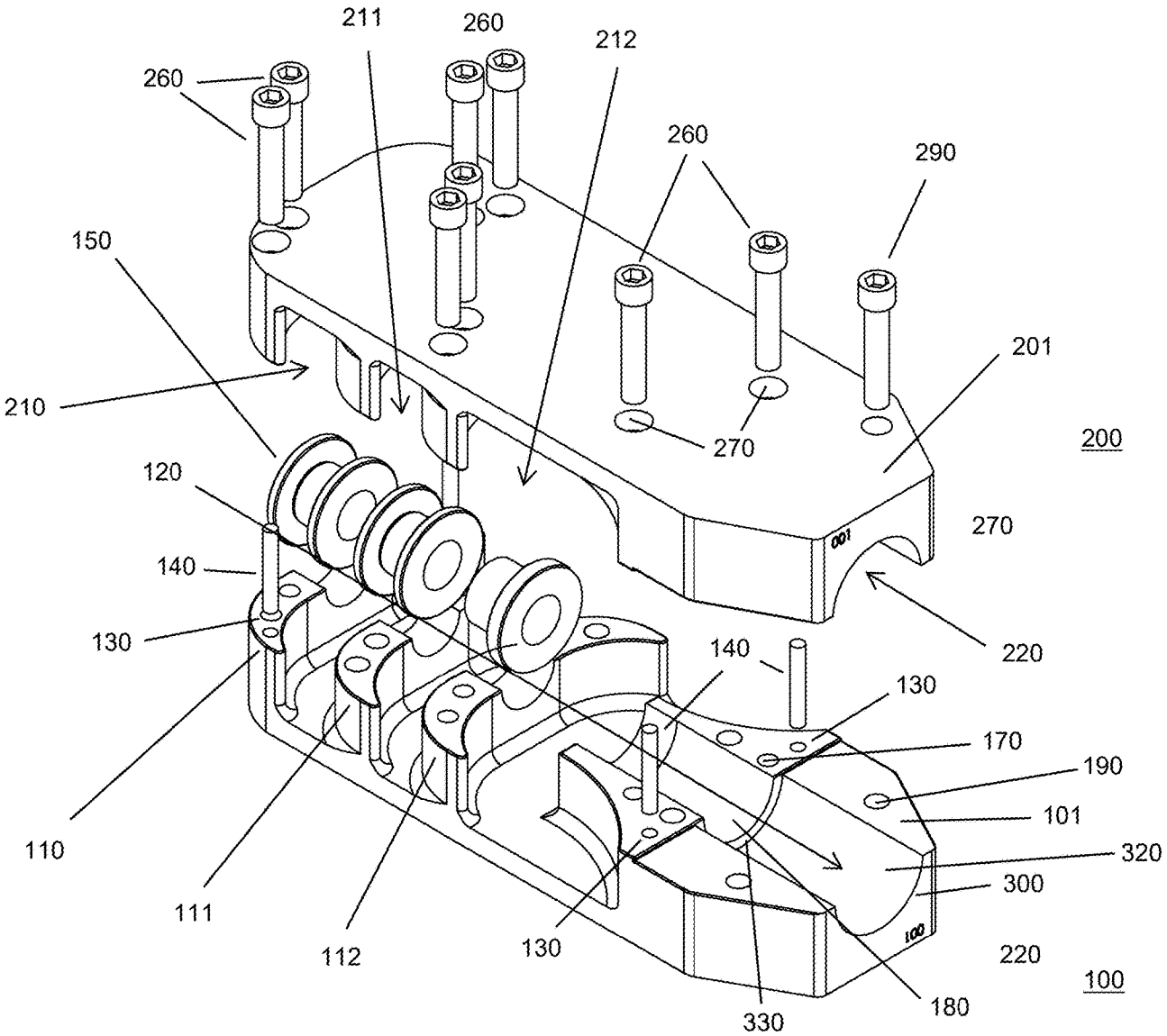
FIG. 1 is an exploded perspective view of one embodiment of the present disclosure, showing two halves of the muzzle brake, each half comprising corresponding curved baffles, a semicircular channel running the length of the brake, circular inserts, and clamping screw receptacles.
Figure 2:
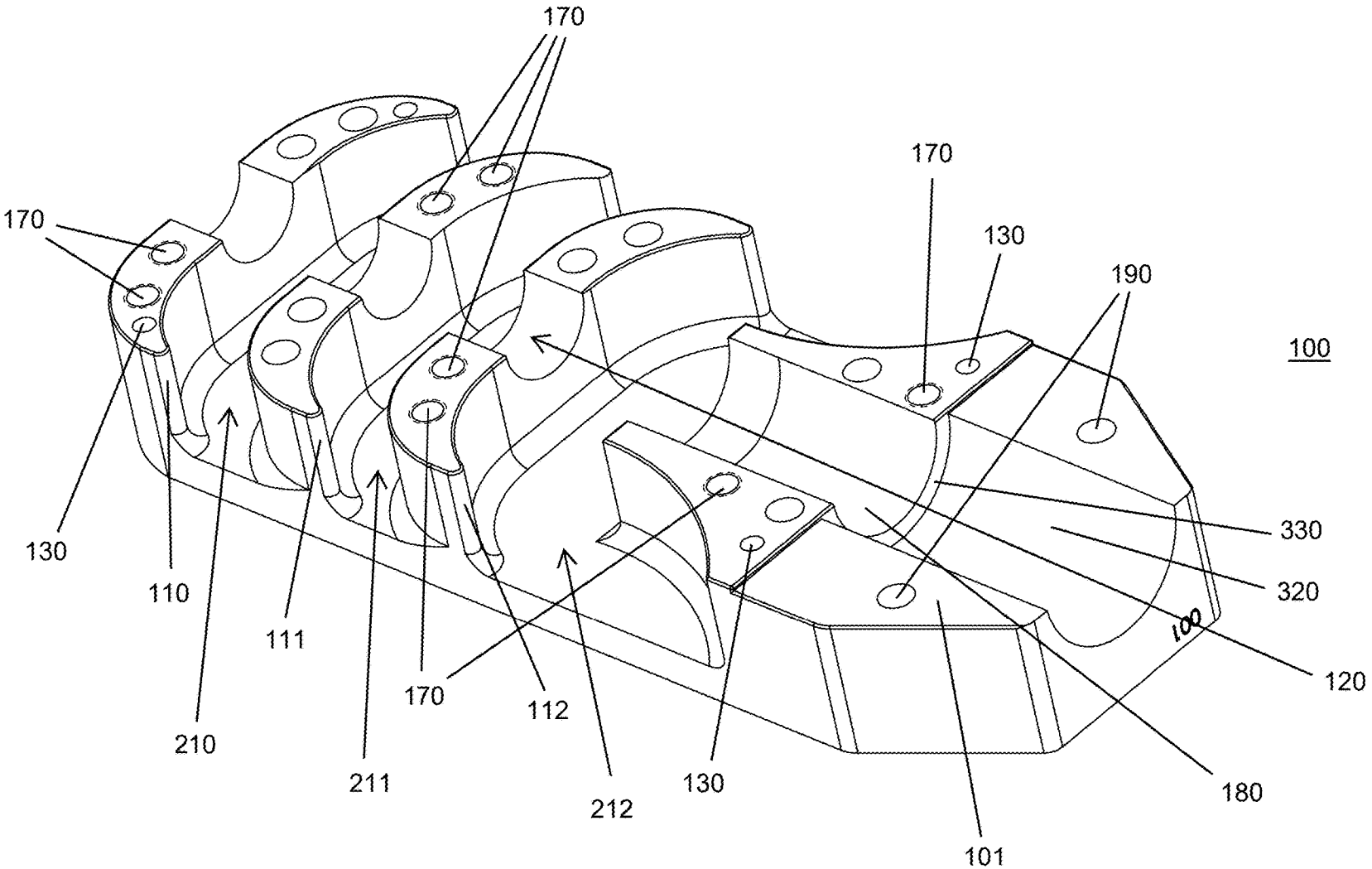
FIG. 2 is perspective view of one embodiment of the present disclosure, showing one half of the muzzle brake, comprised of the curved baffles, and without the circular inserts located in the channel between the baffles.
Figure 3:
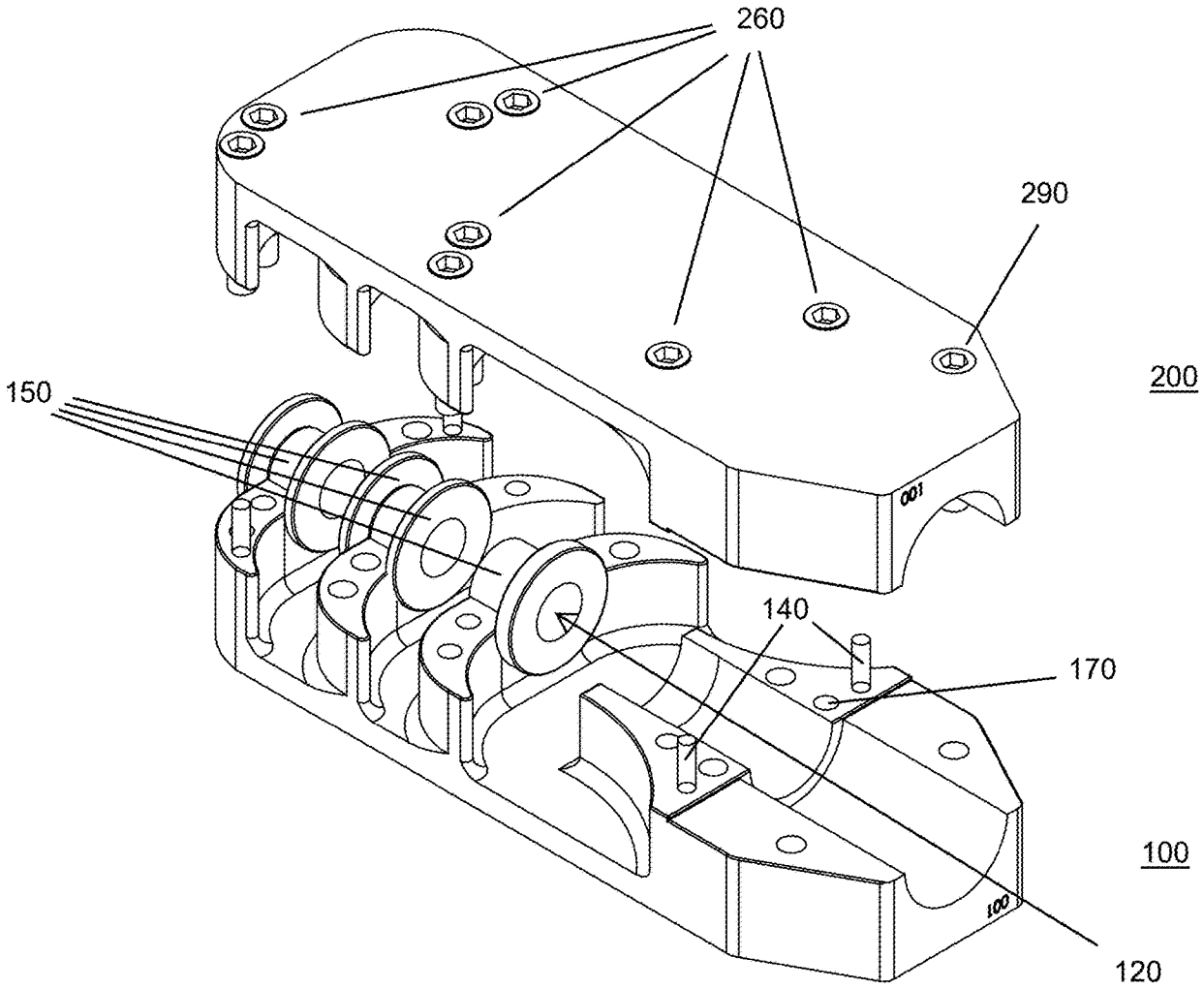
FIG. 3 is an exploded perspective view of one embodiment of the present disclosure, showing two halves of the muzzle brake, each half comprising corresponding curved baffles, circular inserts seated in the longitudinal channel between the baffles, fasteners, clamping screw, and clamping screw receptacles.

Turning now to the drawings, and in particular to FIGS. 1 through 3, one or more embodiments of a reverse thruster muzzle brake for firearms is described. As illustrated in FIG. 1, a first portion of the brake 100 and second portion 200 of the brake are machined to be joined together. Each of the first portion 100 and second portion 200 contains an inner planar surface 101, an outer planar surface 201, and a plurality of curved baffles 110, 111, and 112. Each of the first portion 100 and the second portion 200 also contain a plurality of exhaust ports 210, 211, and 212 on each side for redirection of the gases generated from firing a round. Each of the first portion 100 and second portion 200 further contains a semicircular channel 120/220 formed in the center of the baffles along the longitudinal axis of the brake, which channel corresponds to a longitudinal axis of the firearm barrel. Each of the first portion 100 and second portion 200 further contains a plurality of machined pin receptacles 130 for receiving alignment pins 140.

A plurality of circular inserts 150, each containing a circular passage central to the insert, are inserted into the corresponding channels 120/220 in the baffles of each of the first portion 100 and second portion 200. In embodiments, the circular inserts 150 are machined from hardened steel or other suitable materials.

The first portion 100 and second portion 200 are assembled with the plurality of alignment pins 140 inserted into the alignment pin receptacles 130, and a plurality of threaded fasteners 260 inserted into fastener receptacles 270 on the outer planar surface of the second portion 200 and fastener receptables 170 on the inner planar surface of the first portion 100, with the fasteners tightened to secure the first portion 100 to the second portion 200 and the circular inserts 150 secured in the longitudinal channel. In embodiments, the plurality of fasters that secure the second portion 200 to the first portion 100 are hex-head set screws or other suitable fasteners.

Once the first portion 100 and second portion 200 are joined together and secured with the fasteners, an inner portion 180 of the longitudinal channel is further machined with threads along the interior diameter of the inner portion of the channel to correspond to the threads on the firearm barrel. Once the assembled brake is threaded onto the firearm barrel with the threading on the inner portion of the channel rotated onto the threading of the barrel up to the point of the split break in diameters of the barrel end of the channel, the assembled brake is secured to the barrel with a plurality of clamping fasteners 290 that, when inserted into clamping screw receptables 190 and tightened, secure the aft-most inner diameter 300 of the channel onto the outer diameter of the firearm barrel to secure the brake to the barrel.

FIG. 2 is a detailed perspective view of one embodiment of the present disclosure showing the first portion 100 of the brake. Shown are the inner planar surface 101 of the first portion 100, the plurality of curved baffles 110, 111, and 112, and the plurality of exhaust ports 210, 211, and 212 for redirection of the gases generated from firing a round. In embodiments, each of the first portion 100 and second portion 200 have three curved baffles and three exhaust ports on each side of the brake, as shown in FIGS. 1-3. Also shown in FIG. 2 is the semicircular channel 120 formed in the center of the baffles and the lower portion 100 along the longitudinal axis of the brake, which channel corresponds to the longitudinal axis of the firearm barrel. Also shown is the plurality of machined pin receptacles 130 for receiving alignment pins 140, and the fastener receptacles 170 on the inner planar surface of the first portion 100 for receiving fasteners 260. Also shown is the split machined inner clearance 330 of the channel 120, showing the inner portion 180 of the longitudinal channel that is further machined with threads along the interior diameter of the inner portion of the channel to correspond to the threads on the firearm barrel, as well as the aft portion of the channel 320 having a diameter larger than the inner diameter of the threaded inner portion 180. Finally, shown are clamping screw receptables 190 for receiving clamping fasteners 290 and the brake inner diameter 300 that is secured onto the outer diameter of the firearm barrel when clamping fasteners 290 are tightened.

FIG. 3 is an exploded perspective view of one embodiment of the present disclosure, showing the alignment of the circular inserts 150 in the semicircular channel 120 of the first portion, alignment of the alignment pins 140 in the alignment pin receptacles 130, and the alignment of the fasteners 290 in the fastener receptacles 270 on the outer planar surface 201 of the second portion 200, when the first portion 100 and second portion 200 are assembled.

The features, structures, or characteristics described above may be combined in one or more embodiments in any suitable manner, and the features discussed in the various embodiments may be interchangeable, if possible. In the following description, numerous specific details are provided in order to fully understand the embodiments of the present disclosure. However, a person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims.

The terms "first," "second," etc. are used only as labels, rather than a limitation for a number of the objects. It is understood that if multiple components are shown, the components may be referred to as a "first" component, a "second" component, and so forth, to the extent applicable.

The terms "about" and "substantially," unless otherwise defined herein to be associated with a particular range, percentage, or related metric of deviation, account for at least some manufacturing tolerances between a theoretical design and manufactured product or assembly, such as the geometric dimensioning and tolerancing criteria described in the American Society of Mechanical Engineers (ASME®) Y14.5 and the related International Organization for Standardization (ISO®) standards. Such manufacturing tolerances are still contemplated, as one of ordinary skill in the art would appreciate, although "about," "substantially," or related terms are not expressly referenced, even in connection with the use of theoretical terms, such as the geometric "perpendicular," "orthogonal," "vertex," "collinear," "coplanar," and other terms.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A muzzle brake system for a firearm having a barrel, comprising:

a first portion comprising a plurality of curved baffles with dual exhaust ports, a plurality of machined alignment pin receptacles, a plurality of fastener receptables, a central semicircular channel corresponding to the longitudinal axis of the firearm barrel, and an aft portion of the channel with a larger interior diameter than an adjoining forward portion;

a second matching portion comprising a corresponding plurality of curved baffles with dual exhaust ports, a corresponding channel formed in the center of the baffles, a plurality of corresponding machined alignment pin receptacles, a plurality of corresponding fastener receptables, and a corresponding central semicircular channel corresponding to the longitudinal axis of the firearm barrel, and an aft portion of the channel with a larger interior diameter than the adjoining forward portion, wherein the adjoining forward portion of the interior of the channel is threaded to mate with the threading on the firearm barrel;

a plurality of alignment pins inserted into the corresponding machined alignment pin receptacles in each of the first portion and second portion;

a plurality of fasteners inserted into the corresponding fastener receptables and securing the first portion to the second portion;

a plurality of clamping screws that, when tightened, secure the aft inner diameter of the brake onto the firearm barrel outer diameter to secure the brake to the barrel; and a plurality of circular inserts inserted into the interior channel formed by the first portion and second portion.

2. The muzzle brake system of claim 1, wherein the circular inserts are comprised of hardened steel.

3. The muzzle brake system of claim 2, wherein the circular inserts comprise three inserts.

4. The muzzle brake system of claim 1, wherein the first and second portion are comprised of three baffles and three exhaust ports on each side of the brake.

5. The muzzle brake system of claim 1, wherein the plurality of fasteners are comprised of hex set screws.

6. The muzzle brake system of claim 1, wherein the first portion and second portion of the brake are secured to the firearm barrel with two clamping screws.

7. A method of manufacturing a muzzle brake for a firearm having a barrel, comprising:

machining a first portion comprising a plurality of curved baffles and dual exhaust ports, a channel formed in the center of the baffles, a plurality of machined alignment pin receptacles, a plurality of fastener receptables, and a threaded portion extending from the rearmost port to the barrel-end of the first portion;

machining a second matching portion comprising a corresponding plurality of curved baffles and dual exhaust ports, a corresponding channel formed in the center of the baffles, a plurality of corresponding machined alignment pin receptacles, a plurality of corresponding fastener receptables, and a corresponding central semicircular channel corresponding to the longitudinal axis of the firearm barrel, and a corresponding aft portion of the channel with a larger interior diameter than an adjoining forward portion;

inserting a plurality of alignment pins into the corresponding machined slots in each of the first portion and second portion;

inserting a plurality of fasteners into the corresponding fastener receptables and securing the first portion to the second portion by tightening the fasteners;

machining threading on the interior diameter of the adjoining forward portion of the interior of the channel to mate with the threading on the firearm barrel;

inserting a plurality of clamping screws in the barrel-end of the assembled first portion and second portion and tightening the clamping screws to secure the brake inner diameter onto the firearm barrel outer diameter and secure the brake to the barrel; and inserting a plurality of circular inserts into the corresponding channels in each of the first portion and second portion.

8. The muzzle brake manufacturing method of claim 7, wherein the circular inserts are comprised of hardened steel.

9. The muzzle brake manufacturing method of claim 8, wherein the circular inserts comprise three inserts.

10. The muzzle brake manufacturing method of claim 7, wherein the first portion and second portion are comprised of three baffles and three exhaust ports on each side of the brake.

11. The muzzle brake manufacturing method of claim 7, wherein the plurality of fasteners are comprised of hex set screws.

12. The muzzle brake manufacturing method of claim 7, wherein the first and second portion of the brake are secured to the firearm barrel with two clamping screws.

13. A muzzle brake device for a firearm having a barrel, comprising:

a first portion and a second portion, each portion comprising a plurality of curved baffles and exhaust ports, a plurality of machined alignment pin receptacles, a plurality of fastener receptables, a central semicircular interior channel corresponding to the longitudinal axis of the firearm barrel, and a barrel-end portion of the channel with a first interior diameter smaller than an adjoining second interior diameter;

a plurality of circular inserts inserted into the interior channel formed by the first portion and second portion, a plurality of alignment pins inserted into the corresponding machined alignment pin receptacles in each of the first portion and second portion;

a plurality of fasteners inserted into the corresponding fastener receptables for securing the first portion to the second portion;

the second interior diameter of the channel comprising threads machined to align with the threads of the firearm barrel; and a plurality of clamping screws for securing the second inner diameter of the channel onto an outer diameter of the firearm barrel.

14. The muzzle brake device of claim 13, wherein the circular inserts comprise three inserts.

15. The muzzle brake device of claim 14, wherein the circular inserts are comprised of hardened steel.

16. The muzzle brake device of claim 15, wherein the first portion and second portion are each comprised of three baffles and three exhaust ports on each side of the brake.

17. The muzzle brake device of claim 16, wherein the conjoined first and second portion of the brake are secured to the firearm barrel with two clamping screws.

18. A muzzle brake system for a firearm having a threaded barrel, comprising:

a first portion comprising a plurality of curved baffles with dual exhaust ports, a plurality of machined alignment pin receptacles, a plurality of fastener receptables, a central semicircular channel corresponding to the longitudinal axis of the firearm barrel, and an aft portion of the channel with a larger interior diameter than an adjoining forward portion;

a second matching portion comprising a corresponding plurality of curved baffles with dual exhaust ports, a corresponding channel formed in the center of the baffles, a plurality of corresponding machined alignment pin receptacles, a plurality of corresponding fastener receptables, and a corresponding central semicircular channel corresponding to the longitudinal axis of the firearm barrel, and an aft portion of the channel with a larger interior diameter than the adjoining portion, wherein the adjoining portion of the interior of the channel is threaded to mate with the threading on the firearm barrel;

a plurality of circular inserts inserted into the interior channel formed by the first portion and second portion, a plurality of alignment pins inserted into the corresponding machined alignment pin receptacles in each of the first portion and second portion;

a plurality of fasteners inserted into the corresponding fastener receptables and securing the first portion to the second portion;

a plurality of clamping screws that, when tightened, secure the aft inner diameter of the brake onto the firearm barrel outer diameter to secure the brake to the barrel.

* * * * *